United States Patent [19]

Nakamura

[11] Patent Number: 4,872,576

[45] Date of Patent: Oct. 10, 1989

[54] SOFT-METAL MADE CAN BODY WITH SQUASHING GUIDES

[76] Inventor: Tadashi Nakamura, 346, Futago, Takatsu-ku, Kawasaki-shi, Kanagawa-ken, Japan

[21] Appl. No.: 163,244

[22] Filed: Mar. 2, 1988

[30] Foreign Application Priority Data

Jul. 17, 1987 [JP] Japan ..... 62-109027

[51] Int. Cl.[4] ..... B65D 1/40

[52] U.S. Cl. ..... 220/83; 220/1 R; 220/1 BC

[58] Field of Search ..... 220/83, 72, 1 BC, 1 R, 220/83, 1 R; 215/1 C

[56] References Cited

U.S. PATENT DOCUMENTS

| | | | |
|---|---|---|---|
| 3,353,700 | 11/1967 | Kalina | 220/1 R |
| 3,872,994 | 3/1975 | Hyde | 220/1 R |
| 3,918,603 | 11/1975 | Hatada | 220/1 R |
| 4,322,013 | 3/1982 | Tanaka | 220/1 BC X |
| 4,324,340 | 4/1982 | Belokin, Jr. | 220/1 R |

*Primary Examiner*—Steven M. Pollard

*Attorney, Agent, or Firm*—Cushman, Darby & Cushman

[57] ABSTRACT

Disclosed is a soft-metal made can body which comprises spiral pressure-squashing guides indicated on an outer peripheral surface of the can body. The outer peripheral surface of the can body is pressed along the spiral pressure-squashing guides so as to squash the can body.

1 Claim, 2 Drawing Sheets

SOFT-METAL MADE CAN BODY WITH SQUASHING GUIDES

BACKGROUND OF THE INVENTION:

1. Field of the invention

This invention relates to an aluminum made can body (hereinafter referred to simply as "aluminum can") with squashing guides. The aluminum can constitutes a soft-metalmade can body and is of the type in which beer or other beverages and replace. The aluminum made can body is capable of easily squashed by pressure into a compact size for disposal after it has been emptied.

2. Description of the prior art

An empty aluminum can is thrown, away into a rubbish box, or it is dumped into a rubbish box after it has been squeezed by hands.

When an empty aluminum can is thrown, as it stands, away into a rubbish box, needless to say, it requires the use of a space in the rubbish box that corresponds to the size of the can. This is also true even when it is an empty aluminum can which has been simply squeezed by hands. Consequently, empty aluminum cans occupy a large amount of space, and therefore, a rubbish box becomes full of such cans in a short time.

SUMMARY OF THE INVENTION

The object of the present invention is to provide a soft-metal can body with squashing guides which can be easily squashed by pressure into a compact size of can rubbish after it has been emptied.

The above object is achieved by a soft-metal can body with squashing guides, which comprises spiral pressure-squashing guides indicated on the outer peripheral surface of the soft-metal can body, whereby the outer peripheral surface of the can body may be pressed along the spiral pressure-squashing guides to squash the can body.

According to the present invention, the body of an empty can with spiral pressure-squashing guides indicated thereon is pressed along the squashing guides, and then is compressed both from its top and from its bottom side while it is being twisted along the spiral squashing guides. By so doing, the empty can is squeezed while it is being twisted in the spiral direction. That is to say, the intermediate portion between the top and bottom of the empty can is squashed and is made flat.

DESCRIPTION OF THE PREFERRED EMBODIMENT:

An embodiment of the present invention will now be described with reference to the drawings.

Figure 1:
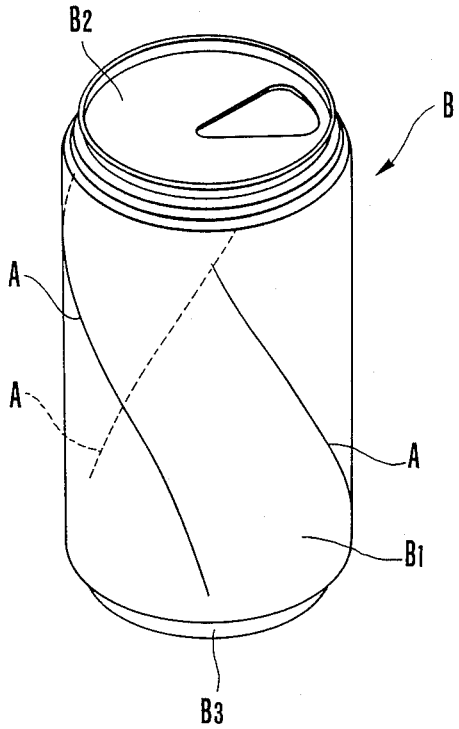
FIG. 1 is a perspective view of an aluminum can as a whole which is printed with squashing guide lines.

Squashing guide lines A, --- are printed on the outer peripheral surface B1 of an aluminum can B together with other printings. However, they may be also indicated beforehand by separate printing. These squashing guide lines A, --- are made three in number on the outer peripheral surface B1 of the aluminum can B in the form of oblique straight lines extending in the same direction, as shown in FIG. 1. The number of the squashing guide lines A, --- is not limited to three, but may be four or more. Further, the squashing guide lines may be also in the form of a single line which spirally extends on the outer peripheral surface of the aluminum can.

The procedure of pressure-squashing the aluminum can B with the squashing guide lines A, --- indicated thereon will be described below.

Figure 2:
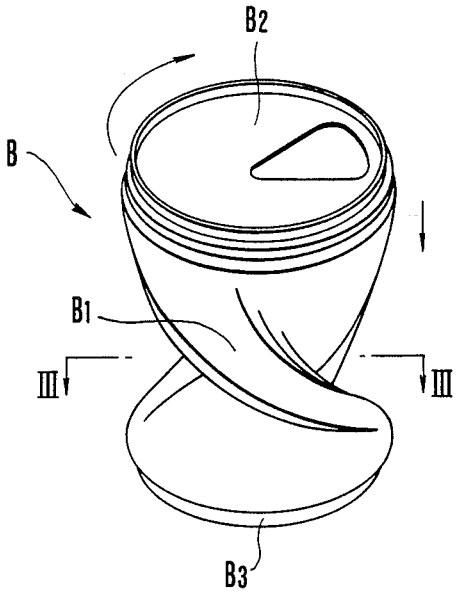
FIG. 2 is a perspective view of the aluminum can in the course of being squashed by pressure.
Figure 3:
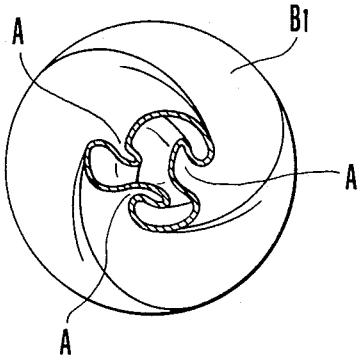
FIG. 3 is a sectional view taken along the line III—III of FIG. 2.
Figure 4:
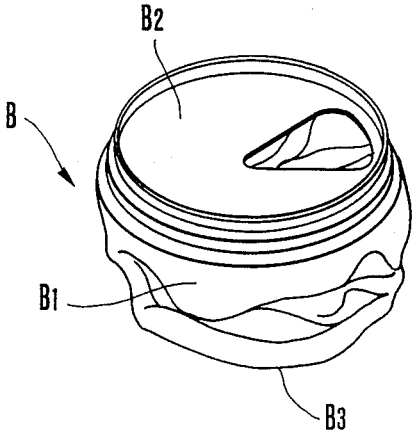
FIG. 4 is a perspective view of the aluminum can in a state wherein it has been squashed by pressure.

First of all, after the aluminum can B has been emptied, the fingers are applied onto the outer peripheral surface B1 thereof along the squashing guide lines A, ---indicated on the same, and the fingers are pressed to cause the depressing of the surface portions applied with them (see FIGS. 2 and 3). Since the aluminum can B is made of soft metal, its outer peripheral surface is depressed simply by being pressed with the fingers, and thus this surface B1 is brought into a state wherein it is depressed while it is twisted. Next, a top B2 and a bottom B3 of the aluminum can B are gripped by both hands, respectively, and then the aluminum can B is compressed while applying the twisting forces thereto in the direction in which the outer peripheral surface B1 is being twisted. By so doing, the aluminum can B is compressed both from the top and from the bottom while it is twisted in the direction in which its outer peripheral surface B1 is being twisted, and thus is squashed. The aluminum can thus squashed has a shape in which the top B2 and the bottom B3 come near to each other thereby assuming a state wherein it is flattened to a height which is equal to, or smaller than, one third of its original height (see FIG. 4).

As has been described above, according to the present invention, the empty aluminum can B can be squashed by pressing with the fingers the squashing guide lines A, ---to thereby bring the outer peripheral surface B1 to a twisted state and thereafter simply compressing the can both from the top and from the bottom while twisting the same by use of the hands, respectively. For this reason, even a powerless person such as a woman or a child can squash such aluminum can. Further, since the aluminum can is able to be flattened to a height which is not greater than one third of the original height prior to squashing, it can be made compact and need not occupy a large amount of space in a rubbish box when it is dumped into the same, thus making it possible to disposed with ease.

Further, according to the above-mentioned embodiment, the squashing guide lines A, ---are printed, or otherwise indicated, on the outer peripheral surface of the aluminum can B to provide an aim for application of the fingers. However, the present invention is not limited to such way of indication. For instance, the aluminum can may be produced by press molding in such a way as to very slight shallow depression or depressions which are concaved or recessed inwardly from the outer peripheral surface of the aluminum can. where the squashing guides are made by such press molding, they may be to an extent that a person who squashes can feel such depression by his finer touching, although not shown. This type of squashing guides facilitates the formation of squashing depressions when pressed.

Since the present invention has the described construction, even a powerless person can easily squash a soft-metal made can body. Consequently, the empty can is made compact in size, is disposed with ease, and need occupy only a small amount of space in a rubbish box.

What is claimed is:

1. A beverage can formed of soft-metal having a smooth, cylindrically shaped outer peripheral surface, a top surface and a bottom surface and spiral pressure-squashing guides printed on said smooth outer peripheral surface of said can body in such a way as not to distort said smooth outer peripheral surface, and extending between said top and bottom surface,said outer peripheral surface of said can-body being adapted to be manually pressed by fingers along said spiral pressure-squashing guides thereby deforming said can body and said can body being further adapted to be crushed by squeezing said top and bottom surfaces together while simultaneously twisting said deformed can body.

* * * * *